US008479937B2

(12) United States Patent
Barange et al.

(10) Patent No.: US 8,479,937 B2
(45) Date of Patent: Jul. 9, 2013

(54) CAP LIFTER FOR PLUGGING CAP, PLUGGING ASSEMBLY INCLUDING A CAP AND SAID CAP LIFTER

(75) Inventors: Jacques Barange, Champillon (FR); Jerome Collard, Epernay (FR); Christian Gonzalez, Hautvilliers (FR); Laurent Hainon, Reims (FR); Nicolas Leduc, Mareuil-sur-Ay (FR); Philippe Christophe, Morangis (FR)

(73) Assignee: EOS, Dizy (FR)

( * ) Notice: Subject to any disclaimer, the term of this patent is extended or adjusted under 35 U.S.C. 154(b) by 614 days.

(21) Appl. No.: 12/523,743

(22) PCT Filed: Mar. 12, 2008

(86) PCT No.: PCT/FR2008/000317

§ 371 (c)(1),
(2), (4) Date: Jul. 20, 2009

(87) PCT Pub. No.: WO2008/132332

PCT Pub. Date: Nov. 6, 2008

(65) Prior Publication Data

US 2010/0078404 A1 Apr. 1, 2010

(30) Foreign Application Priority Data

Mar. 13, 2007 (FR) ..... 07 53785

(51) Int. Cl.
*B65D 51/24* (2006.01)
*B67B 7/15* (2006.01)

(52) U.S. Cl.
USPC ..... 215/305; 215/302; 220/285; 81/3.41

(58) Field of Classification Search
USPC ..... 215/304, 303, 302, 295; 220/285, 220/310.1, 309.1; 81/3.09, 3.07, 3.41, 3.42, 81/3.56, 3.44, 3.4, 3.15, 3.37, 3.36, 3.27, 81/3.29; 7/151
IPC ..... B65D 51/24,7/15, 7/14; B67B 7/15, B67B 7/14
See application file for complete search history.

(56) References Cited

U.S. PATENT DOCUMENTS

| | | | | | |
|---|---|---|---|---|---|
| 2,205,152 | A | * | 6/1940 | Pearson | 81/3.41 |
| 2,440,485 | A | * | 4/1948 | Ranseen | 81/3.56 |
| 2,455,752 | A | * | 12/1948 | Geh | 81/3.56 |
| 2,505,738 | A | * | 4/1950 | Howell | 81/3.25 |
| 2,548,697 | A | | 4/1951 | Belpedio et al. | |

(Continued)

FOREIGN PATENT DOCUMENTS

| | | |
|---|---|---|
| DE | 8815732 | 3/1989 |
| FR | 2187675 | 1/1974 |
| WO | 0134493 | 5/2001 |

*Primary Examiner* — Mickey Yu
*Assistant Examiner* — Robert J Hicks
(74) *Attorney, Agent, or Firm* — Ladas & Parry, LLP

(57) ABSTRACT

A bottle opener for a closure cap for a bottle neck, includes a hood equipped with a first hook including a contact surface with a lower surface of the closure cap, and a transmission lever hinged onto the hood and provided with a gripping section and a working section able to come to bear against an upper surface of the closure cap. It is also provided with two other hooks which include a contact surface with the lower surface and which are offset in the circumferential direction on both sides of the position diametrically opposite the first hook, by an angle of less than 90°, typically ranging between 40° and 80°, and preferably ranging between 40° and 50°.

15 Claims, 7 Drawing Sheets

Figure 1:
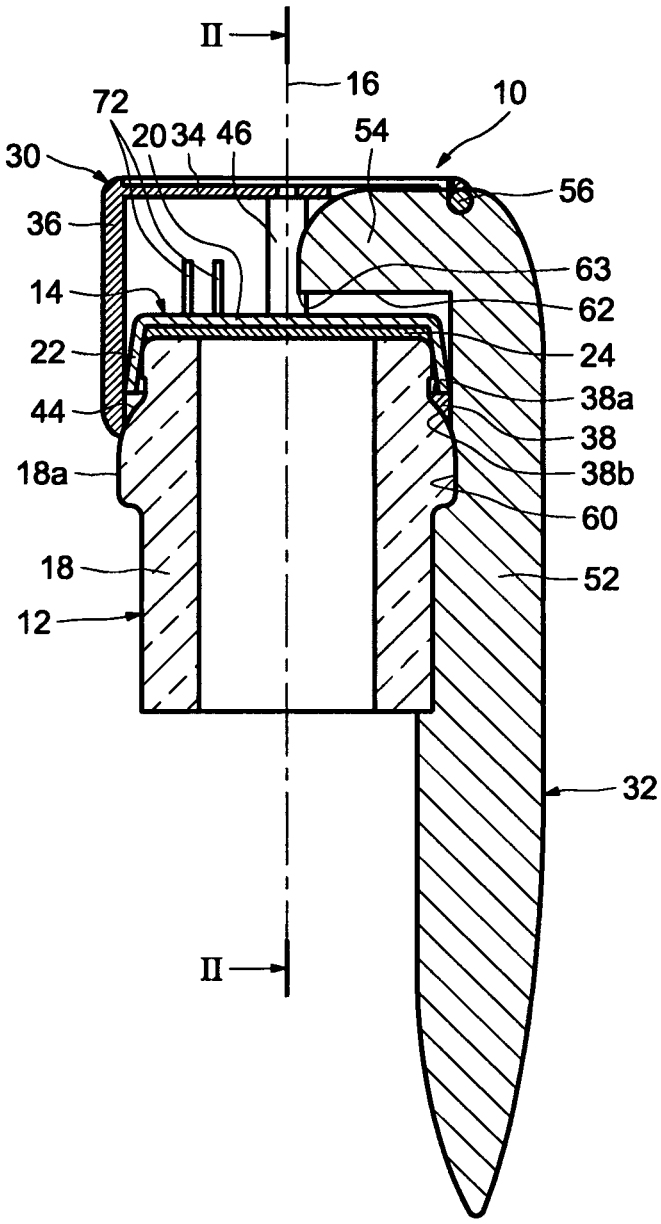

U.S. PATENT DOCUMENTS 2,611,286 A * 9/1952 Baker ..... 81/3.55
2,612,800 A * 10/1952 Dreier ..... 81/3.55
2,757,561 A * 8/1956 Larner ..... 81/3.44
3,038,178 A * 6/1962 Schumacher ..... 7/151
3,266,659 A * 8/1966 Frankenberg ..... 220/270
4,433,597 A * 2/1984 Rowland ..... 81/3.09
4,527,450 A * 7/1985 Drosky ..... 81/3.29
4,680,993 A * 7/1987 Feliz ..... 81/3.37
6,179,138 B1 * 1/2001 Puleston ..... 215/226

* cited by examiner

CAP LIFTER FOR PLUGGING CAP, PLUGGING ASSEMBLY INCLUDING A CAP AND SAID CAP LIFTER

The present invention relates to the field of capping and opening bottles containing beverages. More specifically, the present invention relates to a bottle opener for closure caps for the collar or neck of a bottle, a closure unit including a closure cap and said bottle opener, its manufacturing process, and a composite overcap designed for the production of such a closure unit.

To cap a bottle, a metal cap is conventionally used, provided with a leak-tight seal forming a barrier between the liquid inside the bottle and the surrounding environment. To open a bottle fitted with such a cap, a bottle opener is generally used which comprises a handle and a head provided with an opening so as to rest against a lower surface and an upper surface of the cap.

In addition, American patent U.S. Pat. No. 2,548,697 describes a bottle opener designed to bend and remove a closure cap from the bottle neck with a view to re-using said cap. This bottle opener comprises a hood equipped with a first hook including a contact surface with a lower surface of the closure cap, and a transmission lever hinged onto the hood and provided with a gripping section and a working section able to come to bear against an upper surface of the closure cap.

Whether they have a handle and a head with an opening, or a structure similar to that of U.S. Pat. No. 2,548,697, these bottle openers are effective for uncapping operations, but if it is desired to include an uncapping system into the bottle, they turn out to be unsuitable.

The present invention therefore aims at providing a remedy for this drawback. The purpose of the present invention is also to provide a bottle opener for a bottle closure cap which is particularly practical, effective, simple and economical.

According to a first aspect, the purpose of the invention is to provide a bottle opener for a bottle closure cap, said cap having an upper surface and a lower surface, said bottle opener comprising a hood equipped with a first hook including a contact surface with said lower surface, and a transmission lever hinged onto the hood and provided with a gripping section and a working section able to come to bear against said upper surface. Said bottle opener is also provided with two other hooks which include a contact surface with said lower surface and which are offset in the circumferential direction on both sides of the position diametrically opposite the first hook, by an angle of less than 90°, typically ranging between 40° and 80°, and preferably ranging between 40° and 50°.

Advantageously, said transmission lever is hinged onto said hood so as to be able to swivel around an axis or pivot interdependent with the hood, so that when said transmission lever is swiveled via said gripping section, said working section comes to bear against said upper surface of said cap, and when said transmission lever is further swiveled, the force transmitted at the level of said pivot causes a slight rotation of said first hook.

With such a bottle opener, it is possible to open a cap fitted to a bottle neck in a particularly simple and effective way. When the transmission lever connected to the hood has come to bear against the upper surface of the closure cap and the user continues to turn the transmission lever, the hook tends to move upwards, which causes the cap to be removed.

In addition, providing a hood including the first hook and the other two hooks makes it possible to fit the bottle opener to the bottle, after the cap has been fitted and before said bottle is put on sale. The set of hooks provides a means, or rather a set of means, for holding the bottle opener axially on the cap. Their layout is such that the bottle opener can be held in this way at least until the bottle is opened. This gives a bottle with an integrated cap-removal system.

The first hook is, to advantage, aligned with the transmission lever; it is not offset circumferentially. In other words, it is aligned radially with said transmission lever.

In general, the cap has an external side wall between said upper surface and said lower surface, the latter being typically the end wall of said external side wall. Advantageously, said hooks are laid out on said hood so that they can move radially outwards so as to cross, when first depressed, the external side wall of the cap, and then, once they have crossed said external side wall, move radially inwards, into a position where they are in contact with said lower surface.

Preferably, the hood includes an axial portion in the form of a ring-shaped skirt and the hooks are worked into one axial end of the skirt. The skirt is flexible, or is provided with axial slits defining flexible axial portions, at the end of which are said hooks. The hooks extend radially inwards. Obviously, said hood, which is the body of the bottle opener, may have a more open radial portion and axial portion. It may, for example, simply take the form of a set of three interdependent arms, each arm being provided at its end with one of said hooks. Because of the special role given to the first hook in a preferred embodiment of the invention, the arm associated with this first hook is preferably more rigid than that of the other two arms, which, in contrast, must have a certain amount of flexibility to facilitate fitting the bottle opener onto the cap.

In one embodiment of the invention, the hood comprises a transverse wall referred to in the following as a "radial portion" equipped with at least one elastic component worked onto the radial portion and able to come to bear against the upper surface of the closure cap. The elastic component makes it possible to increase the stability of the bottle opener when it is assembled on the closure cap by substantially limiting the risk of damaging the latter, when it has a slightly convex overall shape.

Advantageously, as the bottle necks are generally provided with a glass ring, the transmission lever includes a recess whose profile matches the shape of said glass ring.

In one embodiment of the invention, the bottle opener also includes an overcap as part of the package design of the bottle.

In one embodiment of the invention the bottle opener is produced using at least one synthetic material, for example by molding. Other materials can obviously also be used, for example metal or wood.

Advantageously, the cap and the transmission lever are provided with means which prevent the transmission lever from returning to its initial position, once the bottle has been uncapped. With such means, the transmission lever, because of the position which it occupies in relation to the bottle, indicates that the cap has at least been pushed in and that air tight capping is no longer guaranteed. In this way, the lever acts as a first opening indicator, whether the bottle has been opened deliberately or not In particular, in the event of accidental opening when handling the bottles, it is an indicator that easily stands out from the mass of capped bottles on sale, and which makes it possible to isolate the defective bottles.

According to one particular embodiment, the transmission lever has pins on the working section, called "first pins", typically at the top part of the end of one or more side walls of said working section. The first pins work in conjunction with pins, called "second pins", typically fitted onto one or more axial flexible brackets connected to the radial portion—or transverse wall—of the hood, located opposite said side walls. In the examples presented hereafter, the transverse wall is provided with two axial flexible brackets which frame said working section and which are placed opposite two side walls of said working section. Before opening, the transmission lever is placed substantially vertically, so that it matches the profile of the bottle as closely as possible. The first pins, laid out on the working section, are located above the second pins, each one opposite a tilted surface (in relation to the horizontal) acting as a slope, so that when the lever is actuated to open the cap the slopes of the first pins come into contact with the slopes of the second pins, then the first pins continue to move downwards while the second pins move outwards as a result of the passage of the first pins, because of the flexibility of said flexible brackets. Before the working section reaches the cap, the first pins reach a sufficiently low position for there to be no more contact with the second pins, so that the flexible brackets return to their initial position by virtue of their elasticity. The first pins and the second pins are then opposite typically horizontal surfaces acting as axial stops, preventing the first pins from going up above the second pins, and consequently the transmission lever from returning to its initial position.

Obviously, it is possible to provide said side wall(s) of the working section and said axial flexible bracket(s) with a plurality of first pins and second pins, in order to produce multiple non-reverse notches. Such a solution is preferred because forces acting, for example, on the end of the gripping arm, while it is in a position different from that in which it was fitted, may be greatly amplified, which may cause said non-reverse notches to burst, thereby eliminating their "first opening indicator" function. In addition, the multiplicity of non-reverse notches makes it possible to immobilize the lever in a position close to the most extreme position forced upon it.

According to a second aspect, the invention also concerns a closure unit comprising a cap to be fitted to a bottle neck, said cap having an upper surface and a lower surface, and a bottle opener provided with a hood comprising a means, or rather a set of means of holding said hood axially onto the cap and a transmission lever hinged onto the hood and provided with a gripping section and a working section able to come to bear against an upper surface of the closure cap. Advantageously said set of axial holding means includes a first hook and at least two other hooks circumferentially offset on both sides of the position diametrically opposite the first hook, the offset angle being less than 90°, and typically ranging between 40° and 80°. Said hooks have a contact surface with the lower surface of said cap. Advantageously, said transmission lever is hinged onto said hood so as to swivel around a pivot, so that when said transmission lever is swiveled via said gripping section, said working section comes to bear against said upper surface of said cap, and when said transmission lever is further swiveled, the force transmitted at the level of said pivot causes a slight rotation of said first hook.

According to another aspect, the invention relates to a manufacturing process for a closure unit including a cap and a bottle opener. The cap is fitted onto the neck of a bottle and the bottle opener is provided with a hood including a set of means for holding said hood axially onto the cap, and with a transmission lever hinged onto the hood and provided with a gripping section and a working section able to come to bear against an upper surface of the closure cap. This process is characterized by the following stages:

a) a closure cap is taken, having an upper surface and a lower surface, for example a crown cap whose transverse wall forms said upper surface and whose lower end of the side or axial wall forms said lower surface;

b) said closure cap is fixed to the bottle neck using conventional means; for example, said crown cap is forced onto the bottle neck;

c) a hood is taken with an axis and including at least one pivot perpendicular to said axis together with a side section provided with a set of axial holding means designed to work in conjunction with the lower surface of said closure cap; for example, a hood is taken with flexible arms or a side skirt split so as to be locally flexible, the portions of skirt or the arms being provided with a plurality of hooks including a surface designed to come up against the lower end of the side wall of the crown cap;

d) said hood and said cap are brought together axially until, once said hood has come up against said closure cap, said axial holding means work in conjunction with the lower surface of said closure cap to prevent said hood from detaching itself from said closure cap;

e) a transmission lever is taken, comprising a gripping section and a working section separated by a zone including a bore, said working section including a lower transverse wall able to come to bear against the upper surface of said closure cap and an end wall, said working section being provided with an open slit connecting said bore to said end wall, said bore having a diameter slightly greater than said pivot, said slit having a width slightly less than said pivot;

f) said transmission lever is brought up in front of the bottle provided with said closure cap and said hood, so that said open slit arrives adjacent to said pivot and said transmission lever is pressed laterally until said pivot is trapped inside said bore.

The material used for the transmission lever is, at least at the level of the working section, and more particularly at that of said open slit, sufficiently flexible to allow the pivot to move into the slit and be trapped by clipping.

To prevent said transmission lever from being easily removed once the pivot has been trapped in its bore, the shape of the edges of the open slit can be modified, for example by attaching a flexible strip directed obliquely in relation to the slit, so that it yields to let the pivot move freely towards the bore but opposes any movement of said pivot in the opposite direction.

To make it easier to fit the transmission lever to the hood at economically satisfactory production rates the hood is advantageously provided with regularly distributed axial studs, typically at least three, whose bottom ends rest against the upper surface of said cap, making it easier to properly position the hood on the cap fitted onto the neck, and in particular to provide good alignment of the axes of the neck and closure cap with the axis of the hood, as well as accurate axial positioning of the hood in relation to the cap.

Advantageously said set of axial holding means includes a first hook and at least two other hooks circumferentially offset on both sides of the position diametrically opposite the first hook, the offset angle being less than 90°, and typically ranging between 40° and 80°.

Advantageously, the gripping section is substantially perpendicular to the working section so that it appears substantially vertically when the transmission lever is pressed sidewards towards the hood, and once the transmission lever has been made interdependent with the hood, it matches the profile of the bottle as closely as possible.

Advantageously, the cap and the transmission lever are provided with means which prevent the transmission lever from returning to its initial position, once the bottle has been uncapped.

In a particularly preferred method of the invention, the closure unit is covered with an overcap, typically a cover such as those which cover the bottles for sparkling drinks. Between stages d) and e), therefore, the following stages are introduced:

d') an overcap is taken including a head and a side skirt with a notch or a window around said pivot when said overcap is fitted onto said hood; for example, said overcap is obtained by sticking a blank in which said window is cut out before being shaped into a truncated cone. This may be also a cover, typically made of tin alloy, which has been stamped and fitted onto a chuck to perform cutting of said window, for example by external application of a rotary tool to the cylindrical skirt of the cover, the profile and planetary motion of which tool have been adapted to the shape of said cut-out;

d") said overcap is fitted around said hood so that said window comes in line with said pivot;

d"') said overcap is applied to said hood and is crimped onto the neck of the bottle by forming a necking on the beading.

But the previous process can advantageously be replaced by a process allowing higher production rates, in which composite overcaps are used where the connection between the overcap itself and said hood is carried out before fitting to the bottle neck. The invention therefore also relates to a composite overcapping cap including an overcap provided with a head and a side skirt and a hood such as that described previously, provided with a head and a side section, laid out coaxially inside said overcap so that said head of said hood is kept interdependent, typically by sticking, with the head of said overcap, said hood including at least one pivot perpendicular to the axis and said side skirt being provided with a window in line with said pivot, said side section being flexible and provided with a set of axial holding means designed to work in conjunction with the lower surface of a closure cap fitted to the neck of a bottle. As described previously, the flexible side portion may take the form of flexible arms or a side skirt that has been split in order to be locally flexible, the portions of skirt or the arms being provided with a plurality of hooks including a surface designed to come up against the lower surface of the closure cap.

Advantageously said set of axial holding means includes a first hook and at least two other hooks circumferentially offset on both sides of the position diametrically opposite the first hook, the offset angle being less than 90°, and typically ranging between 40° and 80°. Said hooks have a surface designed to come into contact with the lower surface of the cap. Said hood has to be made interdependent with a transmission lever via said pivot, around which said transmission lever can be made to swivel via a gripping section, a working section of said transmission lever coming to bear against the upper surface of the cap. Advantageously, the first hook is laid out on the hood so that, when said transmission lever is further swiveled, the force transmitted at the level of said pivot causes a slight rotation of said first hook. This situation comes about favorably when said first hook is aligned radially with the middle of the pivot, whose median plane goes advantageously through the axis of the hood.

Once said composite overcap has been fitted to the neck and made interdependent with it through the joint working between the axial holding means of the hood and the lower surface of the closure cap, the transmission lever is fitted following stages e) and f) already described.

Lastly, the invention also relates to a bottle containing a beverage, in particular a sparkling liquid, provided with a closure unit or an overcap such as defined above.

Figure 2:
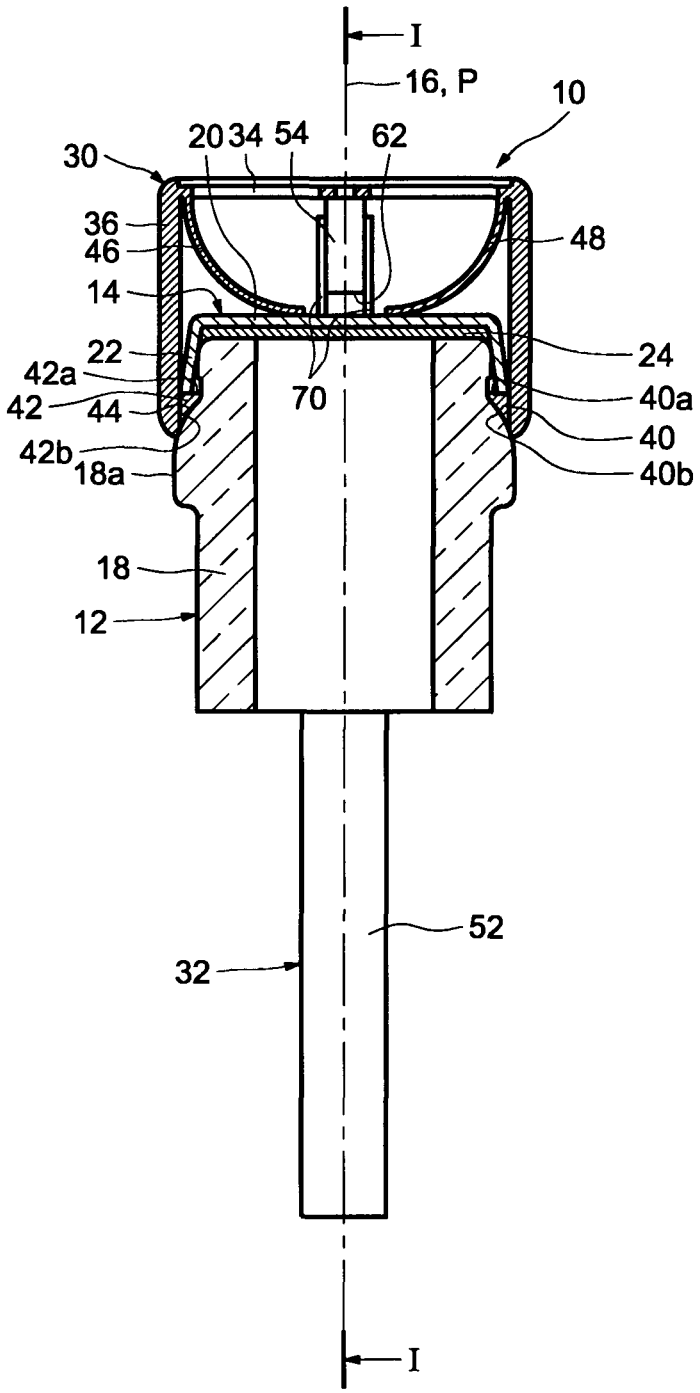
Figure 3:
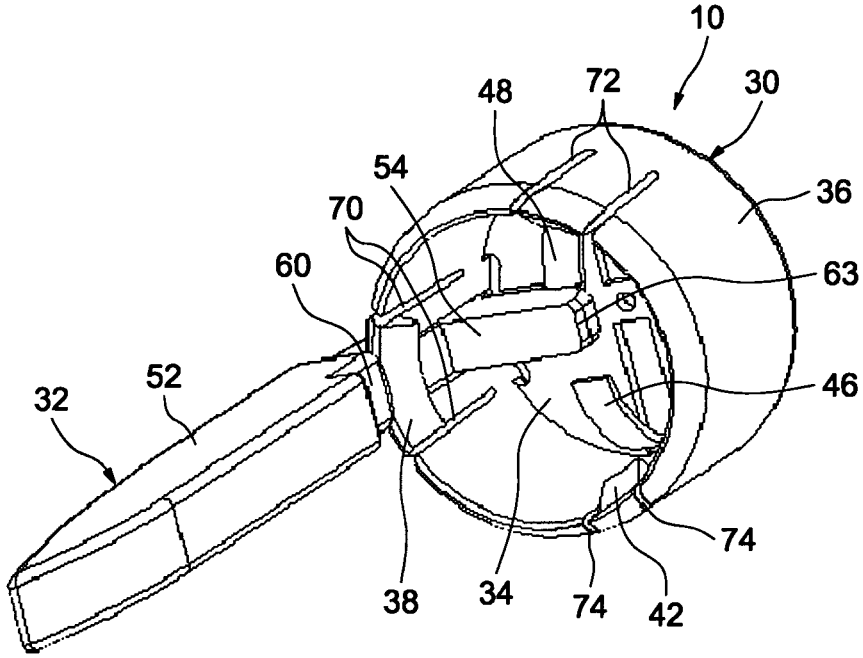
Figure 4:
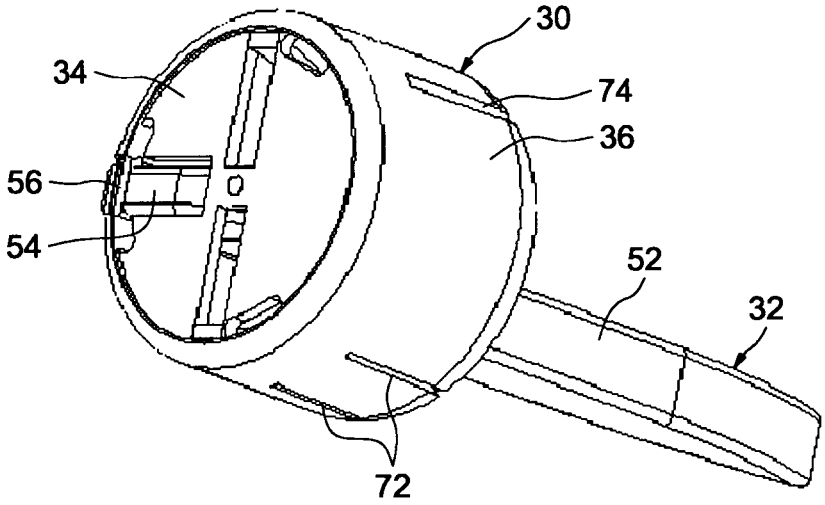
Figure 5:
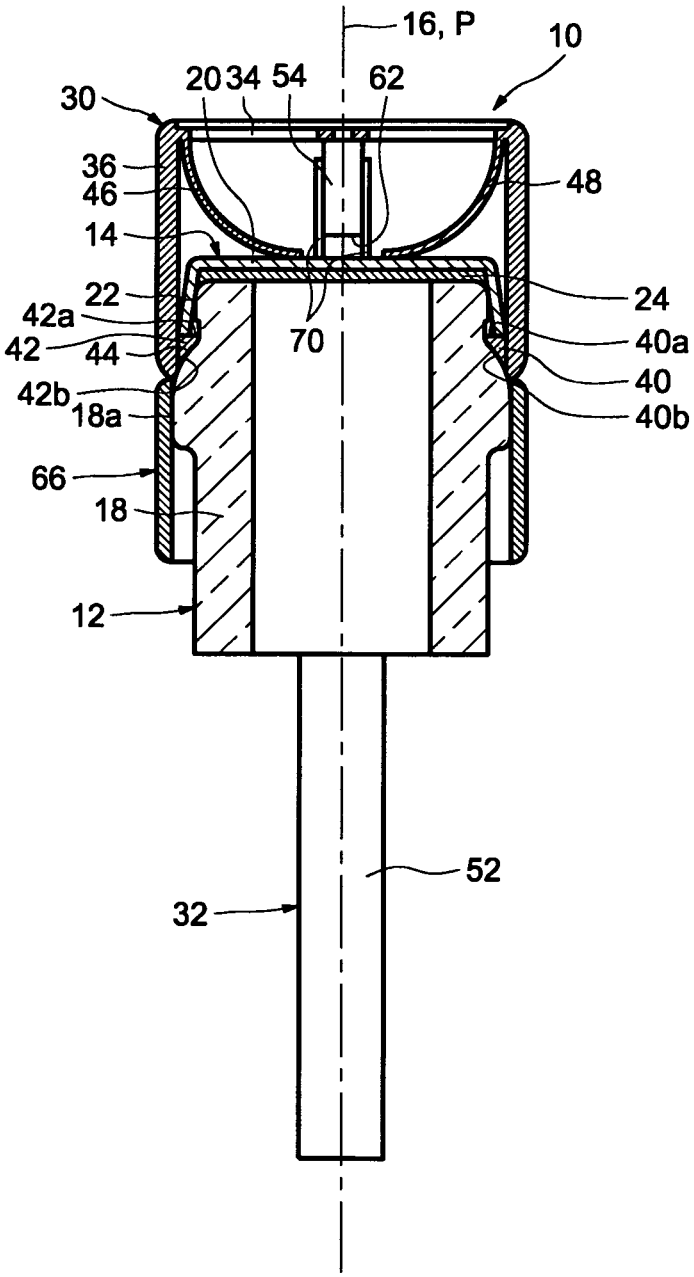

A better understanding of the present invention will be obtained by studying embodiments taken as examples that are in no way restrictive, and illustrated by the drawings to be found in the appendix, in which:

FIGS. 1 and 2 are cross-sections, along I-I and II-II respectively, of a bottle opener according to a first embodiment of the invention assembled on the neck of a bottle, FIGS. 3 and 4 are three-dimensional views of the bottle opener shown in FIGS. 1 and 2;

FIG. 5 is a cross-section of a bottle opener according to a second embodiment of the invention.

Figure 6:
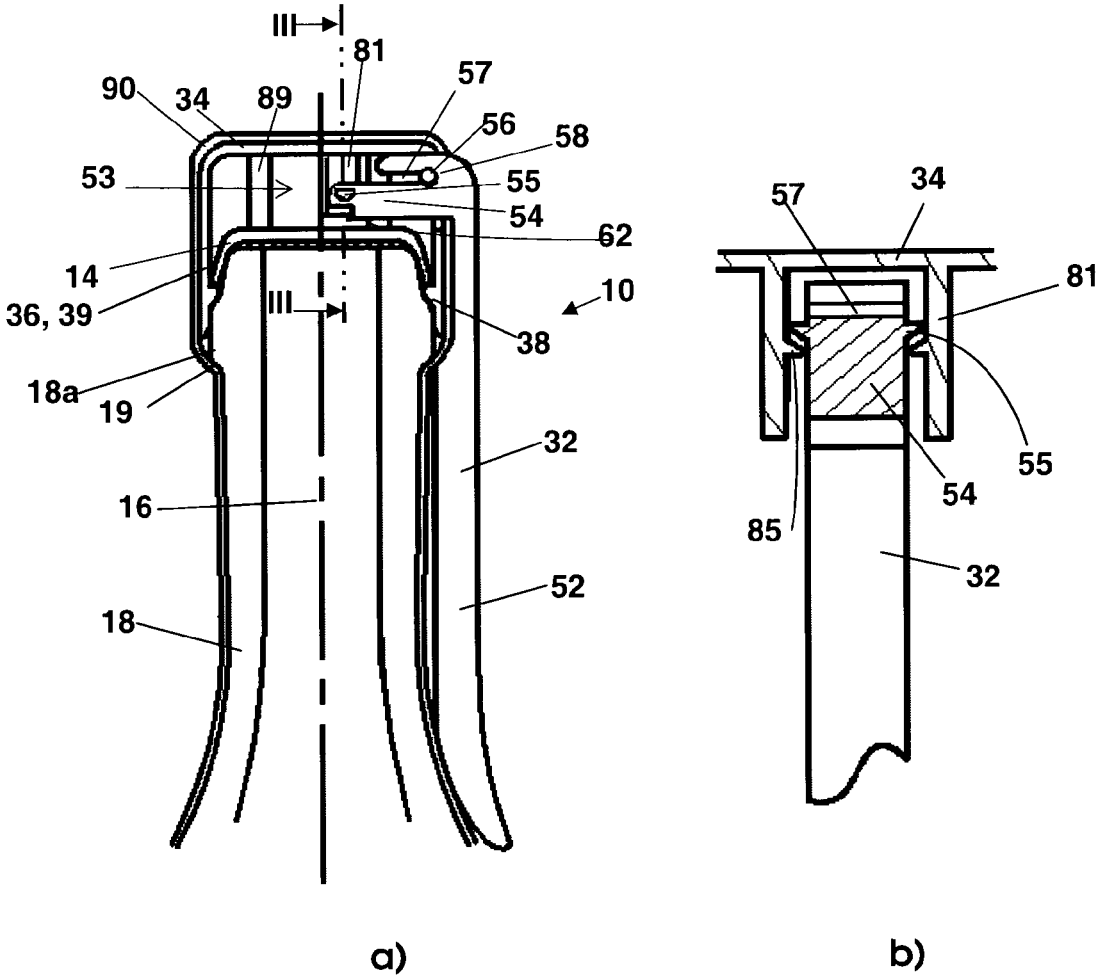
Figure 7:
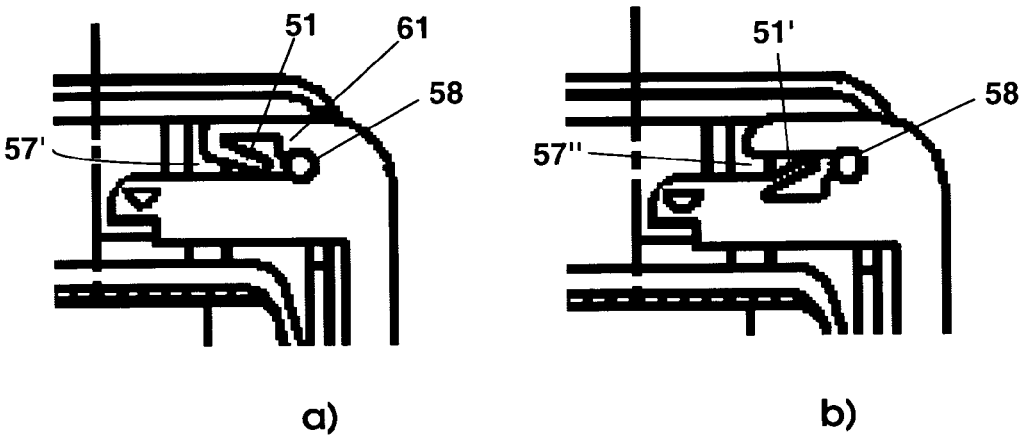

FIG. 6*a* is a diametrical cross-section of a capping unit according to the invention including a closure cap, a bottle opener and an overcap;

FIG. 6*b* shows detail of the closure unit in FIG. 6*a*, at the level of the end of the working section, viewed as a cross-section from the right-hand side along III-III;

FIGS. 7*a* and 7*b* illustrate alternatives for the working section of the transmission lever in FIG. 6*a*, at the level of the open slit.

Figure 8:
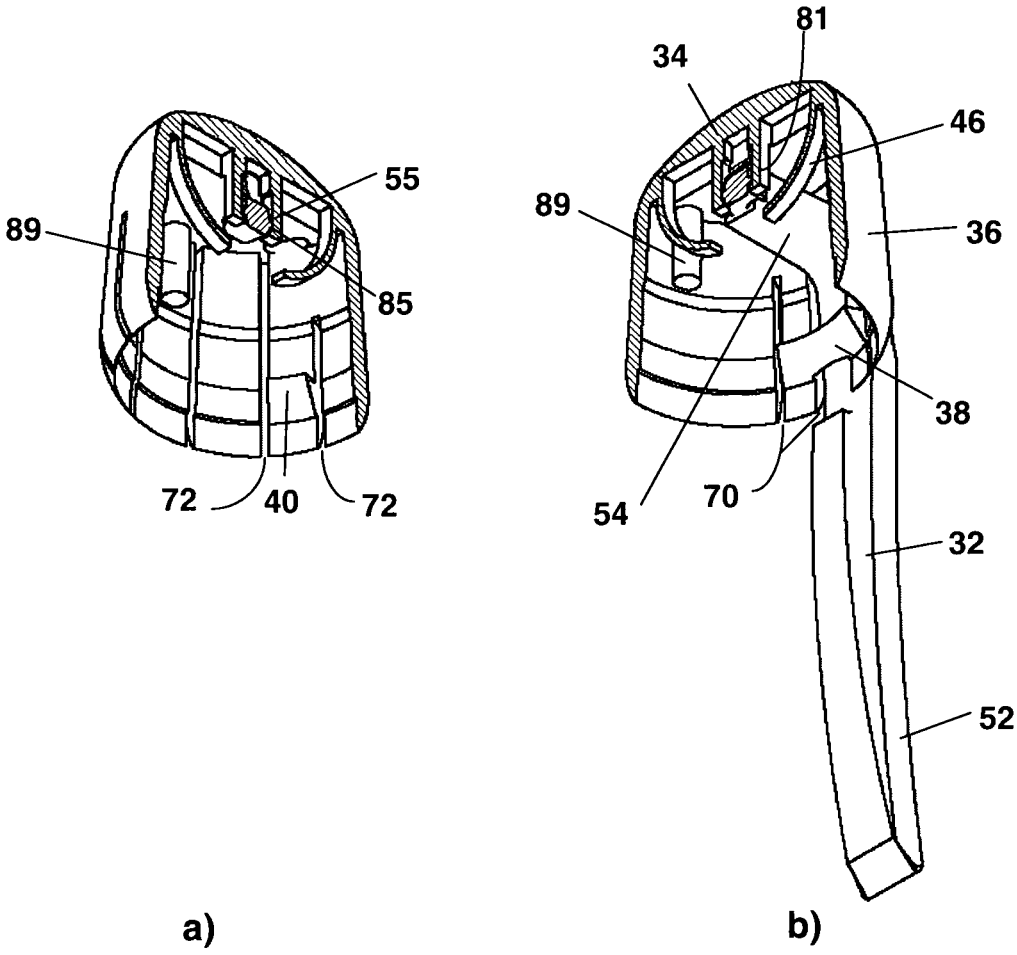

FIGS. 8*a* and 8*b* are perspective views of the two halves of a closure unit according to the invention, similar to that illustrated in FIG. 6*a*.

FIGS. 1 to 4 show a bottle opener 10 intended for opening a bottle 12 onto which is fitted a cap 14. In FIGS. 1 and 2, the bottle opener 10 is shown in a position assumed to be vertical.

Bottle 12, with axis 16, is shown partially here. It includes a collar or neck 18, the top end of which is covered by the cap 14.

The cap 14 includes a side wall or radial portion 20 that closes the top end of the collar or neck 18, and an axial portion 22 designed to be compressed around the circumference of the neck. The axial portion 22 is generally produced as a number of teeth. Cap 14 also includes a seal 24 molded or inserted into the radial portion 20 and the axial portion 22. Seal 24 bears against the top end of neck 18. It can, for example, be made out of polyethylene (PE). Seal 24 is here substantially flat. As a variant, it may also include a short axial skirt protruding inside the neck 18 of the bottle 12.

The bottle opener 10, coaxial with axis 16, primarily comprises a cover or hood 30 and a transmission lever 32, hinged onto hood 30 to allow bottle 12 to be uncapped or opened.

Hood 30 comprises a side wall or radial portion 34 centered on axis 16 and an axial portion in the form of a ring-shaped skirt 36 extending axially downwards from an edge having a large diameter of the radial portion 34. The radial portion 34 is offset axially upwards in relation to cap 14. An axial space is thus engineered between portion 34 of hood 30 and the radial portion 20 of cap 14.

Hood 30 also includes hooks 38, 40 and 42 worked into the free lower end of skirt 36 and extending radially inwards. Hooks 38, 40 and 42 are arranged on the same radial plane.

More specifically, hooks 38, 40 and 42 each comprise a radial surface 38*a*, 40*a*, 42*a* extending radially towards the inside of an internal edge of skirt 36, which is extended at the level of a small-diameter edge by a tapered surface 38*b*, 40*b*, 42*b* widening towards the outside and connected to an outer edge of skirt 36. The radial surfaces 38*a*, 40*a*, 42*a* form contact surfaces with a lower surface of the axial portion 22 of cap 14. The radial dimension of surfaces 38*a*, 40*a*, 42*a* is greater than that of the axial portion 22 of cap 14. The tapered surfaces 38*b*, 40*b*, 42*b* form bearing surfaces on a ring-shaped upper surface 44 of the glass ring 18*a* around the neck 18 of bottle 12.

Hooks 38, 40 and 42 of hood 30 are of a smaller diameter than that of the axial portion 22 of cap 14, so that there exists diametric or radial interference between these two parts.

Hooks 38, 40 and 42 thereby form means of holding hood 30 axially, and more generally of holding bottle opener 10 on cap 14 and bottle 12.

As will be described in greater detail below, when using bottle opener 10, hook 38 makes it possible to obtain removal of cap 14.

Hood 30 also includes slits 70, 72 and 74 worked into the thickness of skirt 36. Slits 70, of which there are two, extend axially from the lower free end of skirt 36 over practically the entire height of the latter. Each slit 70 is located angularly in the immediate vicinity of one of the circumferential free ends of hook 38. In other words, slits 70 delimit, on skirt 36, a tab which includes hook 38 on its free end.

Similarly, slits 72 and 74 are associated with hooks 40 and 42 respectively. However, slits 72 and 74 have a smaller axial dimension than slits 70. Slits 72 and 74 extend here from the lower free end of skirt 36 halfway down the latter.

Hood 30 also includes elastic plates or brackets 46, 48 which are generally curved in shape. Brackets 46, 48 extend from a lower surface of the radial portion 34 of hood 30, until they come to bear against the upper surface of the radial portion 20 of cap 14. The root of brackets 46, 48 is located in the vicinity of skirt 36. Brackets 46 and 48 are symmetrical with each other in relation to an axial median plane P containing axis 16.

In order for the transmission lever 32 to be hinged onto hood 30, the latter also includes an axis or pivot 56 worked into skirt 36, axially in the vicinity of the radial portion 34. Pivot 56 extends perpendicularly to the plane of FIG. 1. Skirt 36 is discontinuous at one point of its circumference and bounded circumferentially by two axial surfaces (no reference numbers) extending over the full height of said skirt. Pivot 56 extends transversely between these two axial surfaces.

Pivot 56 and hook 38 are contained within the median plane P containing axis 16, as will be described in greater detail below. Hook 38 and transmission lever 32 are therefore aligned radially, with no circumferential offset. It should be noted that, in FIG. 1, the isolated section of hook 38 may seem surprising: in fact, as can be seen in a similar configuration illustrated in FIG. 8*b*, hook 38, of which the circumferential extent is significantly larger than the thickness of the lever, typically 2 to 5 times said thickness, forms a kind of "bridge" between two portions of skirt 36 which extend on both sides of the transmission lever 32, one of them being hidden by the latter in the figure.

Transmission lever 32 comprises an axial gripping section 52 and a working section 54, extending a top end of the gripping section radially inwards. Its general shape is that of an L.

The gripping section 52 of the transmission lever 32 appears as a rod which extends axially downwards, along bottle 12. Here 'rod' is taken to mean any part of a generally long and slender shape, whatever its cross section, which can be indifferently rectangular, round, parallelepipedic, oval, etc.

The transmission lever 32 comprises a recess 60 matching the shape of the glass ring 18*a* around the neck 18 of the bottle. Recess 60 makes it possible to position the gripping section 52 against bottle 12.

The gripping section 52 comprises, at its top end, a C-shaped recess (no reference number) corresponding to the diameter of pivot 56 so that the transmission lever 32 can be clipped onto said pivot 56. It is obviously possible for the transmission lever 32 to be fitted onto hood 30 by any other suitable means.

The working section 54 of the transmission lever 32 has an overall rectangular shape and extends radially towards the inside of skirt 36, through the space engineered between the two axial surfaces circumferentially bounding said skirt. Working section 54 comprises a lower radial surface 62 whose free end or point 63 is designed to bear against the upper surface of the radial portion 20 of cap 14. Working section 54 is designed so that point 63 is substantially located at the level of axis 16.

The transmission lever 32 can to advantage be made in a single piece by molding a synthetic material, such as polyoxymethylene (POM) or polycarbonate (PC). In a similar way, hood 30 is also obtained by molding a synthetic material, for example POM or PC, so as to obtain a single-piece part. Transmission lever 32 and hood 30 can be made from the same material or from different materials, for example from metal or vegetable materials.

To remove the cap 14, one proceeds as follows:

In the first stage, the bottle 12 opener 10 is fitted to the neck of bottle so that hooks 38, 40 and 42 clip under cap 14, i.e so that the radial contact surfaces 38*a*, 40*a* and 42*a* come to bear against the lower surface of the axial portion 22 of cap 14. In this position, the tapered surfaces 38*b*, 40*b* and 42*b* rest against the upper surface 44 of the beading 18*a* around bottle 12. Bottle opener 10 is made easier to fit by the presence of slits 70, 72 and 74.

Next, transmission lever 32 is pivoted around pivot 56, via gripping section 52, so that the working section 54, and more specifically, point 63, come to bear against the upper surface of the cap 14. When one continues to pivot transmission lever 32, the force exerted at the level of pivot 56 is transmitted to hook 38, which causes a slight rotation of said hook, and more specifically of the tab of skirt 36 bounded by slits 70, towards the outside. This thus gives simultaneously a radial movement towards the outside and an axial movement towards the top of hook 38. During this rotation of the tab of skirt 36 including hook 38, part of cap 14 protrudes slightly in a radial direction in relation to the rest of skirt 36.

When one continues to pivot the transmission lever 32, bottle 12 is uncapped. Bottle opener 10 is then withdrawn from bottle 12, the cap 14 remaining captive inside it, via hooks 38, 40 and 42.

So when using bottle opener 10, transmission lever 32 moves from a rest position to a working position in which point 63 of the working section 54 presses against the upper surface of cap 14, and in which hook 38 exerts a force on the lower surface of cap 14. Hooks 40 and 42 make it possible to ensure that hood 30 is maintained in position on bottle 12, by means of surfaces 40*b*, 42*b* whose shape matches that of the upper surface 44 of the glass ring 18*a* around bottle 12.

The layout of hook 38 and transmission lever 32 in the same axial plane P makes it possible to remove cap 14 successfully: the force exerted by the user on transmission lever 32 once the working section 54 bears against cap 14, is transmitted directly to hook 38.

In addition, the applicant determined that the lack of a hook radially opposite hook 38 makes it possible to facilitate uncapping. The applicant also noticed that the layout of hooks 40 and 42 makes it possible to hold the hood firmly 30 on the cap 14, when they are offset in the circumferential direction on both sides of the position diametrically opposed to the first hook, by an angle of less than 90°, typically ranging between 40° and 80°, and preferably between 40° and 50°, for example 45°.

The applicant further noted that to obtain proper uncapping during movement of hook 38 when acted upon by transmission lever 32, the circumferential dimension of said hook 38 advantageously lies between 10 and 15% of the circumferential dimension of skirt 36. The circumferential dimension of hooks 40, 42 can to advantage be equal to half that of hook 38. The angular dimension of hook 38 can, for example, be about 45°.

In an alternative embodiment it can easily be seen that it is nevertheless possible, without moving outside the framework of the invention, to envisage a different number of hooks or a continuous or segmented radial rib. However, as stated above, the use of three hooks makes it possible to obtain particularly effective uncapping and stable positioning of bottle opener 10 on bottle 12.

The embodiment illustrated in FIG. 5, in which identical parts bear the same references, differs in that bottle opener 10 further comprises an overcap 66, generally ring shaped, which extends a bottom end of skirt 36 axially downwards. Cover 66 comes to bear against the glass ring 18*a* and extends axially along bottle 12 in the vicinity of the ring. To make it easier to be fitted around bottle 12, cover 66 can to advantage be split.

Cover 66 can be used to contribute to the package design of bottle 12, or present easily visible information about the liquid contained in bottle 12. To this end, the axial dimension of overcap 66 can to advantage lie between 50 and 300% of that of hood 30. However, it is also possible to envisage an overcap that covers the bottle down to its base.

In this embodiment, overcap 66 is formed using the same procedure and material as skirt 36 in order to obtain a single-piece hood 30. It can easily be imagined that it is also possible to make two distinct parts and to make provision for adding overcap 66 onto hood 30.

The invention makes it possible to have a bottle opener which is particularly simple and effective to use. In addition, the existence of at least one hook forming an axial means of holding the hood onto the cap makes it possible to fit the bottle opener onto a bottle before it is put on sale. This gives a bottle provided with a closure unit made up of the cap and the bottle opener which, once bought by the consumer, can be opened without any external accessory.

It is easy to imagine that such a closure unit could be provided for bottles designed to allow the conditioning of various types of liquids, such as water, wine, fruit juices, alcoholic beverages, or sparkling drinks of the soda or Champagne type. Moreover, in the case of sparkling drinks of the Champagne type, a satisfactory degree of safety is obtained when opening the bottle, by preventing the stopper from being blown out.

The embodiment illustrated in FIG. 6*a*, in which identical elements have the same references as previously, is particularly well suited for bottles for sparkling drinks such as champagnes or sparkling wines. The closure unit comprising a cap 14 fitted to the neck 18 of a bottle, a bottle opener 10 including a hood 30 and a transmission lever 32, is covered with a cap or overcap 90.

The hood 30 includes a transverse wall or radial portion 34 in the form of a transverse top wall centered on axis 16 and a pivot 56 directed horizontally, i.e. perpendicular to axis 16 of the neck. It also includes a ring-shaped skirt 36 extending axially downwards from the periphery of the radial portion 34. This skirt 36 is split so that it reveals at least flexible axial portions provided at their ends with axial holding means, such as hooks 38, 40 and 42 described in the previous examples, which arrive axially up against the lower surface of cap 14. The radial portion 34 is offset axially upwards in relation to cap 14. Elastic strips, generally curved in shape, extend from a lower surface of the radial portion 34, until they come to bear against the upper surface of the radial portion 20 of cap 14. The hood is also provided with three regularly distributed axial studs 89, which make it easier to position the hood properly on the cap fitted to the neck. Also attached to the lower surface of the radial portion 34, two flexible axial brackets 81 frame the working section 54 of the transmission lever 32. The axial brackets flexible 81 are provided with pins, called second pins 85.

The set of axial holding means includes a first hook 38 and at least two other hooks circumferentially offset on both sides of the position diametrically opposite the first hook, the offset angle being less than 90°, and typically ranging between 40° and 80°. The first hook 38 is laid out on the hood so that when the transmission lever 32 is swiveled further, the load transmitted at the level of pivot 56 causes a slight rotation of said first hook which is aligned radially with the middle of the pivot 56, whose median plane goes through axis 16.

The transmission lever 32 includes a gripping section 52 and a working section 54 separated by a zone including a bore 58. Said working section includes a transverse wall or lower radial surface 62, whose end 63 is able to come to bear against the upper surface of the cap 14, an end wall 53 and two side walls. The working section 54 is provided with an open slit 57 connecting bore 58 to the end wall 53. The end wall 53 is that which is directed towards the axis when the transmission lever 32 is fitted to the cap. Bore 58 has a slightly greater diameter than that of pivot 56. Slit 57 is slightly less wide than the diameter of pivot 56. Lever 32 is made of a sufficiently flexible plastic so that, when fitting the transmission lever onto hood 30, the edges of the slit open out to let pivot 56 through until it is trapped in bore 58. To prevent said transmission lever 32 from being easily removed once pivot 56 has been trapped in bore 58, the shape of the edges of the open slit can be modified as illustrated in the two variants of FIGS. 7*a* and 7*b*, by attaching a flexible strip 51, 51' to it, directed obliquely in relation to slit 57', 57", so that it yields to let pivot 56 move freely towards bore 58 but also so that it is opposed to any movement of pivot 56 in the opposite direction. The trapping of pivot 56 in bore 58 is completed in these two variants by the presence of a radial rib 61.

The closure unit can be produced in this way just after bottling and can remain as is during transport and storage of the bottle before it is opened, thanks to hooks 38, 40 and 42 which have upper surfaces 38*a*, 40*a* and 42*a* acting as axial stops against the lower surface of the cap. The upper surface 38*a* also helps to drive part of the cap upwards during uncapping. When uncapping, the fact that the gripping section 52 rises causes the working section to lower until it comes into contact with the cap; it then creates an upward force which is transmitted by the pivot to hook 38, which tends to raise part of the cap, while the lower surfaces 40*b* and 42*b* of the other two hooks 40 and 42 come into contact with the upper part of the glass ring 18*a*. In this way, the stability of the cap is ensured, when fitting the transmission lever, by the lower ends of the axial studs 89 and, when uncapping, by the lower surfaces 40*b* and 42*b* of said hooks.

The end of the working section 54 is also provided with pins 55 on its side walls, called first pins. The first pins 55 work in conjunction with the second pins 85. Before uncapping, the first pins 55 are located above the second pins 85, each one being opposite a tilted surface acting as a slope so that, when the gripping section 52 is raised to open the cap, the first pins 55, coming into contact with the slopes of the second pins 85, continue their movement downwards while the second pins 85 move outwards under the effect of the passage of the first pins 55, thanks to the flexibility of the flexible brackets 81. Before the working section 54 reaches the cap, the first pins 55 reach a sufficiently low position for there to be no more contact with the second pins 85, so that the flexible brackets 81 return to their initial position by virtue of their elasticity. The first pins 55 and the second pins 85 are then opposite typically horizontal surfaces acting as axial stops, preventing the first pins 55 from going up above the second pins 55, and consequently the transmission lever 32 from returning to its initial position.

Cap 90 is an overcap for a bottle of champagne. It is formed of a head and a skirt, made of metal, plastic or metalloplastic, obtained from a film or from a single or multi-layer sheet. Before shaping the skirt into a truncated cone, the film or sheet is cut out, in order to obtain a window giving free access to the working section 54. This window has dimensions which correspond typically to those of the discontinuity of skirt 36 of hood 30, delimited by two axial surfaces which support pivot 56. Overcap 90 is crimped onto the beading 19.

The embodiment corresponding to FIGS. 8*a* and 8*b*, in which the elements identical to those already described previously have the same references, is similar to the preceding embodiment. In this embodiment, hook 38 forms a circumferential bridge between two portions of skirt 36, made flexible by slits 70.

What is claimed is:

1. A bottle opener, a bottle closure cap and a bottle having a neck, said cap having an upper surface and a lower surface, said bottle opener including a hood comprising an annular skirt adapted to radially surround the cap, and a first hook formed at one axial end of the skirt and including a contact surface with said lower surface, and a transmission lever hinged onto said hood and provided with a gripping section and a working section able to come to bear against said upper surface, wherein:

said hood is also provided with two other hooks formed at said axial end of the skirt and which include a contact surface with said lower surface and which are offset in the circumferential direction on both sides of the position diametrically opposite the first hook, by an angle less than 90°;

wherein the annular skirt includes slits extending axially from said axial end and delimiting, on said annular skirt, a tab which includes one of said hooks; and wherein the transmission lever is hinged onto said hood so as to swivel about an axis which is aligned radially with said hook of the tab, so that when said transmission lever is swiveled via said gripping section, said working section comes to bear against said upper surface of said cap, and when said transmission lever is further swiveled, the force transmitted at the level of said axis causes a slight rotation of said tab and associated hook.

2. A bottle opener, according to claim 1, in which the first hook is aligned radially with the transmission lever.

3. A bottle opener according to claim 1, in which the hood includes a radial portion equipped with at least one elastic component worked onto the radial portion and able to come to bear against the upper surface of the closure cap.

4. A bottle opener according to claim 1, in which the transmission lever includes a recess matching a beading around the bottle.

5. A bottle opener according to claim 1, further including an overcap as part of the package design of the bottle.

6. A bottle opener according to any of the preceding claims, made with at least one synthetic material.

7. A bottle opener according to claim 1, in which said working section of said transmission lever and said hood are provided with a first opening means, which prevents said transmission lever from returning to its initial position when the bottle has been uncapped.

8. A bottle opener according to claim 7 in which said working section has at least one side wall, said hood is provided with at least one flexible axial bracket located opposite said side wall, and in which said means of first opening are at least one first pin laid out on said side wall, and at least one second pin laid out on said axial bracket, said first pin and second pin being arranged so that said first pin is initially laid out above said second pin and opposite a tilted surface which acts as a slope, then, when the transmission lever is actuated to open the cap, the slope of said first pin comes into contact with the slope of said second pin, said first pin continuing its movement downwards while the second pin moves outwards under the effect of the passage of said first pin, thanks to the flexibility of said flexible bracket, and finally, when the working section has reached the cap, said first pin is in a sufficiently low position for there to be no more contact with said second pin, so that said flexible bracket returns to its initial position by virtue of its elasticity, said first pin and said second pin then being located opposite surfaces which act as axial stops, preventing said first pin from rising above said second pin, and consequently said transmission lever from returning to its initial position.

9. A closure unit including a cap and a bottle opener, said cap designed to be fitted onto a neck of a bottle, having an upper surface and a lower surface, wherein said bottle opener comprises a hood having an annular skirt adapted to radially surround the cap, said hood having a first hook formed at one axial end of the skirt and including a contact surface with said lower surface, and a transmission lever hinged onto said hood and provided with a gripping section and a working section able to come to bear against said upper surface, wherein said hood is also provided with two other hooks formed at said axial end of the skirt and which include a contact surface with said lower surface and which are offset in the circumferential direction on both sides of the position diametrically opposite the first hook, by an angle less than 90°;

wherein the annular skirt includes slits extending axially from said axial end and delimiting, on said annular skirt, a tab which includes one of said hooks; and wherein the transmission lever is hinged onto said hood so as to swivel about an axis which is aligned radially with said hook of the tab, so that when said transmission lever is swiveled via said gripping section, said working section comes to bear against said upper surface of said cap, and when said transmission lever is further swiveled, the force transmitted at the level of said axis causes a slight rotation of said tab and associated hook.

10. A closure unit according to claim 9 in which said transmission lever is hinged onto said hood so as to swivel around an axis, so that when said transmission lever is swiveled via said gripping section, said working section comes to bear against said upper surface of said cap, and when said transmission lever is further swiveled, the force transmitted at the level of said axis causes a slight rotation of said first hook.

11. A manufacturing process for a closure unit including a cap and a bottle opener, said cap being fitted onto a neck of a bottle, said neck having a beading, and said bottle opener being equipped with a hood including a set of axial holding means for said hood onto the cap and with a transmission lever which is hinged onto said hood and is provided with a gripping section and a working section able to come to bear against an upper surface of the closure cap, wherein the following stages are performed:

a) a closure cap is taken having an upper surface and a lower surface;

b) said closure cap is fitted to a neck of a bottle;

c) a hood is taken with an axis and including at least one pivot perpendicular to said axis together with a side section provided with a set of axial holding means designed to work in conjunction with the lower surface of said closure cap;

d) said hood and said cap are brought together axially until said axial holding means work in conjunction with the lower surface of said closure cap to prevent said hood from detaching itself from said closure cap;

e) a transmission lever is taken, comprising a gripping section and a working section separated by a zone including a bore, said working section including a lower transverse wall able to come to bear against the upper surface of said closure cap and an end wall, said working section being provided with an open slit connecting said bore to said end wall, said bore having a diameter slightly greater than said pivot, said slit having a width slightly less than said pivot; and f) said transmission lever is brought up in front of the bottle provided with said closure cap and said hood, so that said open slit arrives adjacent to said pivot and said transmission lever is pressed laterally until said pivot is trapped inside said bore.

12. A manufacturing process according to claim 11 in which said transmission lever has an open slit of which at least one edge is provided with a strip directed obliquely in relation to said slit, so that, during stage f), said lever yields to let said pivot pass freely towards the bore but opposes any movement of said pivot in the opposite direction.

13. A manufacturing process according to claim 11 in which said hood is provided with regularly distributed axial studs having a bottom end, wherein said bottom end of said studs come to bear against the upper surface of said cap, making it easier to position the hood stably on the cap fitted to the neck, especially during stage f).

14. A manufacturing process according to claim 11, wherein the following stages are introduced between stages d) and e):

d') an overcap is taken including a head and a side skirt with a notch or a window around said pivot when said overcap is fitted onto said hood;

d") said overcap is fitted around said hood so that said window comes in line with said pivot; and d"') said overcap is applied to said hood and is crimped onto the neck of the bottle by forming a necking on the beading.

15. A bottle containing a liquid for drinking, provided with a closure unit, said closure unit including a cap and a bottle opener, said cap designed to be fitted onto a neck of the bottle, having an upper surface and a lower surface, wherein said bottle opener comprises a hood having an annular skirt adapted to radially surround the cap, said hood having a first hook formed at one axial end of the skirt and including a contact surface with said lower surface, and a transmission lever hinged onto said hood and provided with a gripping section and a working section able to come to bear against said upper surface, wherein said hood is also provided with two other hooks formed at said axial end of the skirt and which include a contact surface with said lower surface and which are offset in the circumferential direction on both sides of the position diametrically opposite the first hook, by an angle less than 90°;

wherein the annular skirt includes slits extending axially from said axial end and delimiting, on said annular skirt, a tab which includes one of said hooks; and wherein the transmission lever is hinged onto said hood so as to swivel about an axis which is aligned radially with said hook of the tab, so that when said transmission lever is swiveled via said gripping section, said working section comes to bear against said upper surface of said cap, and when said transmission lever is further swiveled, the force transmitted at the level of said axis causes a slight rotation of said tab and associated hook.

* * * * *